US005931066A

United States Patent [19]

Waynick

[11] Patent Number: 5,931,066

[45] Date of Patent: Aug. 3, 1999

[54] SELF-LEVERING INTERLOCKING WRENCHES

[76] Inventor: Linn A. Waynick, 2244 Pell Rd., Brookport, Ill. 62910

[21] Appl. No.: 08/886,537

[22] Filed: Jul. 1, 1997

[51] Int. Cl.[6] ..... B25B 13/16

[52] U.S. Cl. ..... 81/177.2; 81/124.4; 81/119; 81/125.1

[58] Field of Search ..... 81/177.1, 177.2, 81/124.4, 124.7, 125.1, 119

[56] References Cited

U.S. PATENT DOCUMENTS

| | | | |
|---|---|---|---|
| 1,371,533 | 3/1921 | Wright | 81/177.2 |
| 1,746,452 | 2/1930 | Wesson | 81/177.2 |
| 2,142,589 | 1/1939 | Olson | 81/177.2 |
| 3,324,748 | 6/1967 | Williams | 81/124.4 |
| 3,850,057 | 11/1974 | Evans . | |
| 4,811,638 | 3/1989 | Kertzscher . | |
| 4,960,014 | 10/1990 | Kelley . | |
| 5,136,902 | 8/1992 | Ma . | |

*Primary Examiner*—James G. Smith
*Attorney, Agent, or Firm*—Terrance L. Siemens

[57] ABSTRACT

A set of interlocking wrenches wherein each wrench is configured to engage a second wrench of the set when the two wrenches are placed end to end to extend length and leverage of the first wrench. Each individual wrench has an elongated handle, a box style working head located at one end of the handle, and an open ended working head located at the other end of the handle. A recessed notch or receptacle is formed at the base of the box style working head of each wrench of the set. The notch is configured to cooperate with a jaw of the open ended working head of another wrench of the set, so that two wrenches may be placed end to end and securely engage one another. The notch has surfaces serving as stops maintaining the open ended working head in engagement with the first wrench. The second wrench employed to increase effective length of the first wrench is constrained against slipping out of engagement by the notch when the second wrench is subjected to force increasing torque applied to the first wrench.

16 Claims, 5 Drawing Sheets

SELF-LEVERING INTERLOCKING WRENCHES

BACKGROUND OF THE INVENTION

1. Field of the Invention

The present invention relates to wrenches, and more particularly to a hand wrench adapted to cooperate with a second wrench. When leverage beyond that available due to the length of one wrench is required, the wrench engages a second wrench. The second wrench extends the effective length of the first, so that additional torque may be applied.

2. Description of the Prior Art

Wrenches may occasionally be of insufficient length to offer leverage required to perform a given task. In such cases, the person using the wrench is obliged to extend the effective length of the wrench in order to develop sufficient torque to complete the task at hand. The user may resort to methods such as slipping a pipe over the wrench. Alternatively, the prior art has suggested apparatus for solving this problem.

An extension for the handle of a wrench is shown in U.S. Pat. No. 4,960,014, issued to Roy C. Kelley on Oct. 2, 1990. Kelley's extension comprises a planar member having two hook-like projections for engaging the wrench. By contrast, the present invention provides a notch in the head of a wrench so that this wrench cooperatively engages the jaws of a second, open ended wrench.

U.S. Pat. No. 4,811,638, issued to Ernst Kertzscher on Mar. 14, 1989, describes a wrench having an opening formed therein for receiving the square drive of a ratchet wrench. The notch formed in the present invention differs from the square hole of Kertzscher in location on the head of the wrench, in that it does not penetrate entirely through the wrench, and that it enables a web of structural material to extend continuously along the opening of the jaw of the wrench for resisting torsional forces generated by turning the wrench against resistance.

Wrenches displaying variations to the usual configuration of the jaws of an open end wrench are seen in U.S. Pat. No. 3,850,057, issued to James Preston Evans on Nov. 26, 1974, and U.S. Pat. No. 5,136,902, issued to Homer W. Ma on Aug. 11, 1992. Modification of the openings of the wrench in this latter group affect the interior configuration of the jaw opening when seen in profile, and would not enable engagement by a second, conventional open end wrench in the manner of the present invention. By contrast, the notch formed in the wrench head of the present invention is oriented not to affect the profile of the opening for receiving a bolt head, and adapts a box end wrench to engage an open ended wrench. The improvements of Evans and Ma are disposed upon heads of open end wrenches, whereas the present invention improves upon heads of box end wrenches.

None of the above inventions and patents, taken either singly or in combination, is seen to describe the instant invention as claimed.

SUMMARY OF THE INVENTION

The present invention provides combination wrenches wherein each combination wrench is configured to cooperate with a second wrench of a set of wrenches which are generally similar but of a variety of nominal sizes when any two wrenches are placed in end to end engagement for the purpose of extending effective length and leverage of one. A combination wrench is a wrench having an elongated handle, a box style working head located at one end of the handle, and an open ended working head located at the other end of the handle. It is reasonably easy to engage the idle jaw of an open ended working head of a combination wrench when that wrench is placed on a work piece, should the wrench require additional leverage to turn the work piece. However, when the open end is placed on the work piece and the wrench requires additional leverage, the situation is far more difficult.

In the latter situation, a box style working head is exposed for engaging an auxiliary device used to increase length and leverage. This presents difficulties in achieving secure engagement, since the two open, parallel surfaces presented by the jaws of an idle open ended working head are absent. Instead, a circular working head having at best a square or hexagonal opening formed therein presents itself. It is difficult enough to find structure for successfully engaging a box style working head for applying additional torque. The situation is aggravated since most sets of combination wrenches available today have offset heads. In the case of the box style working head, offset signifies that the plane occupies by the working head is arranged at a slight angle to the elongated handle of the wrench.

The present invention answers this problem by modifying conventional box style working heads to include structure adapted to securely engage an open ended working head of a second wrench. The structure forms a notch or receptacle which constrains the open ended head from ready slippage when torque is applied to turn the wrench being lengthened by attachment of the second wrench. The second wrench need have no special configuration beyond reasonable dimensional compatibility with the notch or receptacle of the first wrench. In practice this is almost assured since open ended working heads of wrenches generally have flat lateral faces and are fabricated in a narrow range of thicknesses.

In a preferred embodiment of the invention, a set of combination wrenches is provided. The set is conventional in that it includes one wrench of each nominal dimensional size within a range of nominal dimensional sizes of progressively greater or smaller magnitude. Each wrench has a notch or receptacle formed at the base of its associated box style working head, which receptacle is dimensioned and configured to cooperate with a jaw of the open ended working head of another wrench of the set. Preferably, the receptacles are dimensioned and configured to cooperate with a wrench of the next nominal size provided by the set.

Upon engagement and application of torque, the auxiliary wrench imposes a couple on the primary wrench, where the primary wrench is that engaging the work piece and the auxiliary wrench is that employed to increase effective length of the primary wrench. The couple is resisted, and thus transmitted to the primary wrench, by the base of the receptacle of the primary wrench and by one surface of the box style working head. While this relationship is frequently attempted with conventional combination wrenches, it typically fails unexpectedly due to slippage of the auxiliary wrench. The present invention greatly increases security of engagement, thereby enabling the auxiliary wrench to be successfully employed to extend length and leverage of the primary wrench. The present invention enables the user of the wrenches to utilize a second wrench for increasing leverage rather than to require the user to obtain an additional tool for this purpose.

Accordingly, it is a principal object of the invention to provide a wrench having structure for securely engaging an auxiliary wrench connected thereto for the purpose of extending effective length and leverage.

It is another object of the invention that the novel wrench engage a jaw of an open ended wrench.

It is a further object of the invention to eliminate requirements for an additional tool for engaging an exposed box end of a combination wrench to increase length and leverage thereof.

Still another object of the invention is to cause linear alignment between a primary wrench and an auxiliary wrench when positioned end to end to increase length and leverage of the primary wrench.

An additional object of the invention is to render a box style working head of a wrench suitable to engage an open ended working head of a second wrench.

It is again an object of the invention to enable engagement of a box style working head by an open ended working head of another wrench despite offset of the box style working head from its handle.

Still another object of the invention is to secure a jaw of an open ended wrench immobilized while engaging a box style working head of another wrench.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
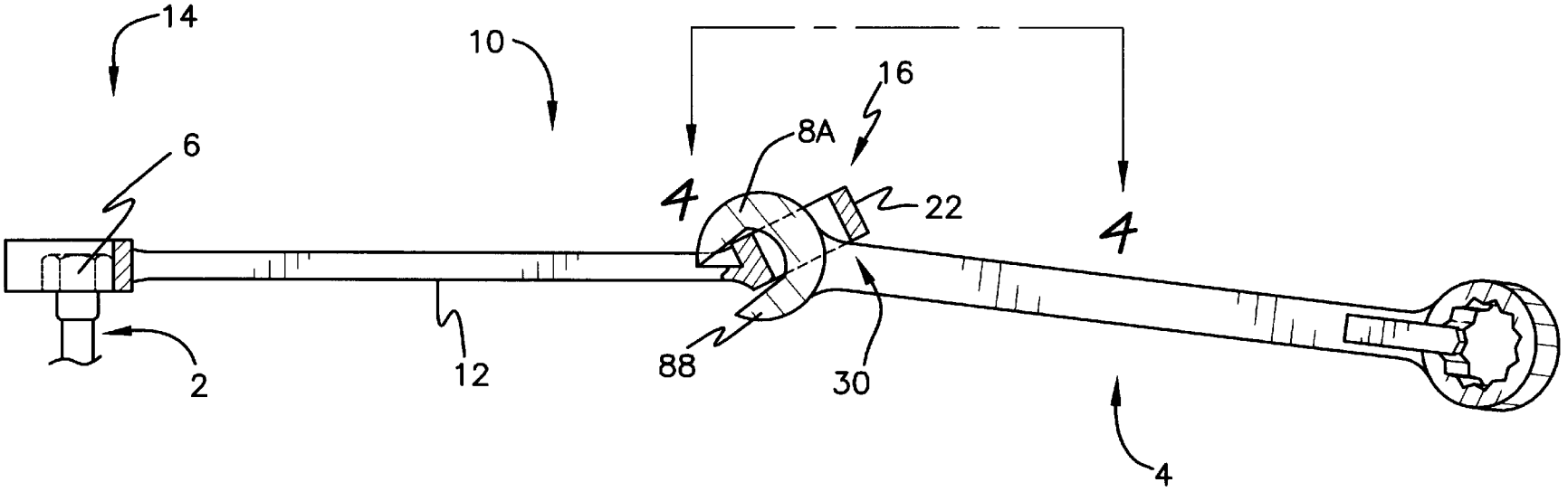
FIG. 1 is an environmental, side elevational view of the invention as applied to one wrench, shown partially in cross section.

Turning now to FIG. 1 of the drawings, an interlocking wrench 10 is shown engaged with a work piece 2 and with an auxiliary wrench 4 to increase effective length of and leverage obtainable by wrench 10. Wrench 10 is of the combination type, having an elongated handle 12, and open ended working head 14 fixed to the distal end of elongated handle 12, and a box style working head 16 fixed to the proximal end of elongated handle 12. Open ended working head 14 is shown engaging the head 6 of work piece 2. For purposes of description, each working head 14 or 16 has work gripping structure for engaging the work piece, or any external object to be rotated. The gripping structure of open ended head 14 comprises conventional opposed jaws 18 (see FIG. 2) each bearing a flat surface 20.

Figure 2:
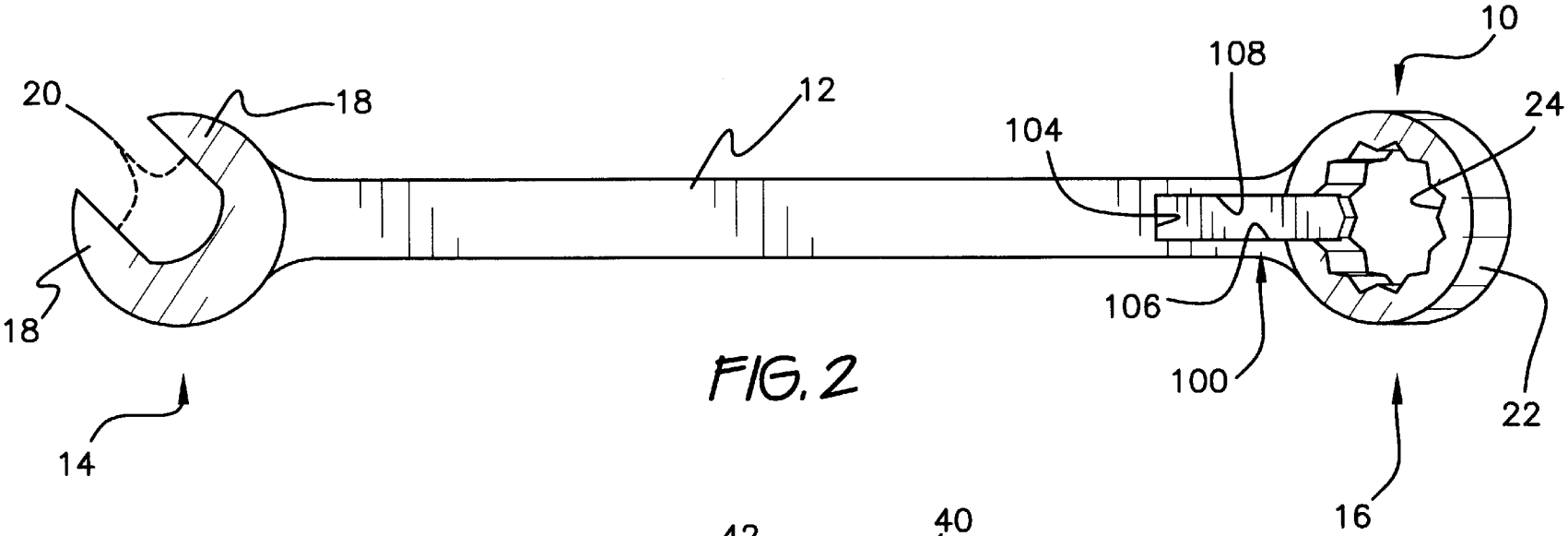
FIG. 2 is a top perspective view of the invention, as applied to one wrench.
Figure 3:
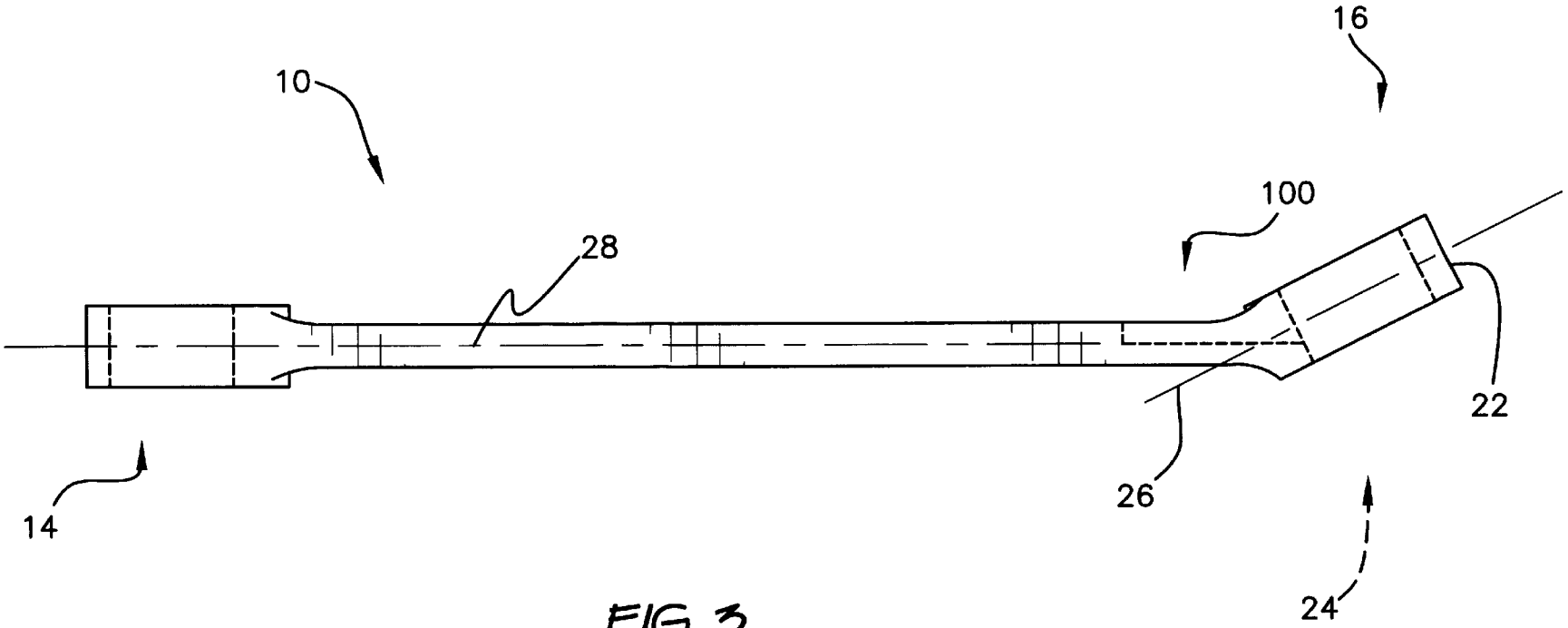
FIG. 3 is a side elevational view of the invention, as applied to one wrench.

Referring now to FIG. 2, the gripping structure of box style working head 16 comprises a generally circular or annular member 22 having an inner work engaging surface 24. As depicted throughout the drawings, surface 24 comprises a configuration popularly known as twelve pointed, for engaging hexagonal bolt heads and the like. Box style working head 16 may be rotated in thirty degree increments to offer positional adjustability in engaging the work piece. A central plane of open ended working head 14 is generally coplanar with handle 12, although this characteristic is not critical and does not always occur. Although the novel principles apply to other wrench styles as well as to that depicted herein, box style working head 16 is offset from handle 12 in that it has a central plane 26 (see FIG. 3) disposed non-parallel to the central plane 28 of handle 12.

The foregoing construction is conventional. The point of novelty lies in a wrench engagement receptacle 100 recessed into wrench 10. Receptacle 100 has a base surface 102 and forms lateral walls serving as stops for constraining wrench 4 from escaping engagement. The lateral walls form a forward stop 104 projecting above base surface 102 between wrench engagement receptacle 100 and the distal end of handle 12, a right lateral stop 106 disposed at the right side of base surface 102, and a left lateral stop 108 disposed at the left side of base surface 102. Designations as right and left are purely arbitrary, and are introduced only for semantic clarity.

Receptacle 100 is recessed into wrench 10, the recess formed thereby intersecting inner work engaging surface 24 of the work gripping structure of working head 16. Receptacle 100 preferably, although not necessarily, extends into handle 12 in the direction of the distal end of wrench 10, this being illustrated in the drawings. When wrench 10 is first placed into engagement with work piece 2, box style working head 16 is idle, in that it is not required to engage and turn work piece 2. The present invention solves the problem of successfully engaging wrench 10 for the purpose of improving leverage by combining the length of both wrench 10 and an second tool, the second tool being auxiliary wrench 4. A jaw 8A (see FIG. 1) of auxiliary wrench 4 may be slid into interlocking engagement with wrench 10 after passing through the work gripping structure of working head 16.

FIG. 1 shows the final engaged position of wrench 4 after maneuvering wrench 4 into place. Jaw 8A of wrench 4 abuts forward stop 104, thereby being securely from sliding or otherwise moving forwardly out of the engaged position. The handle of wrench 4 contacts member 22 at a point of contact generally designated at 30 in FIG. 1. Point of contact 30 is not a fixed, predetermined point on member 22, and will vary with dimensions and configurations of both wrenches 4, 10.

Figure 4:
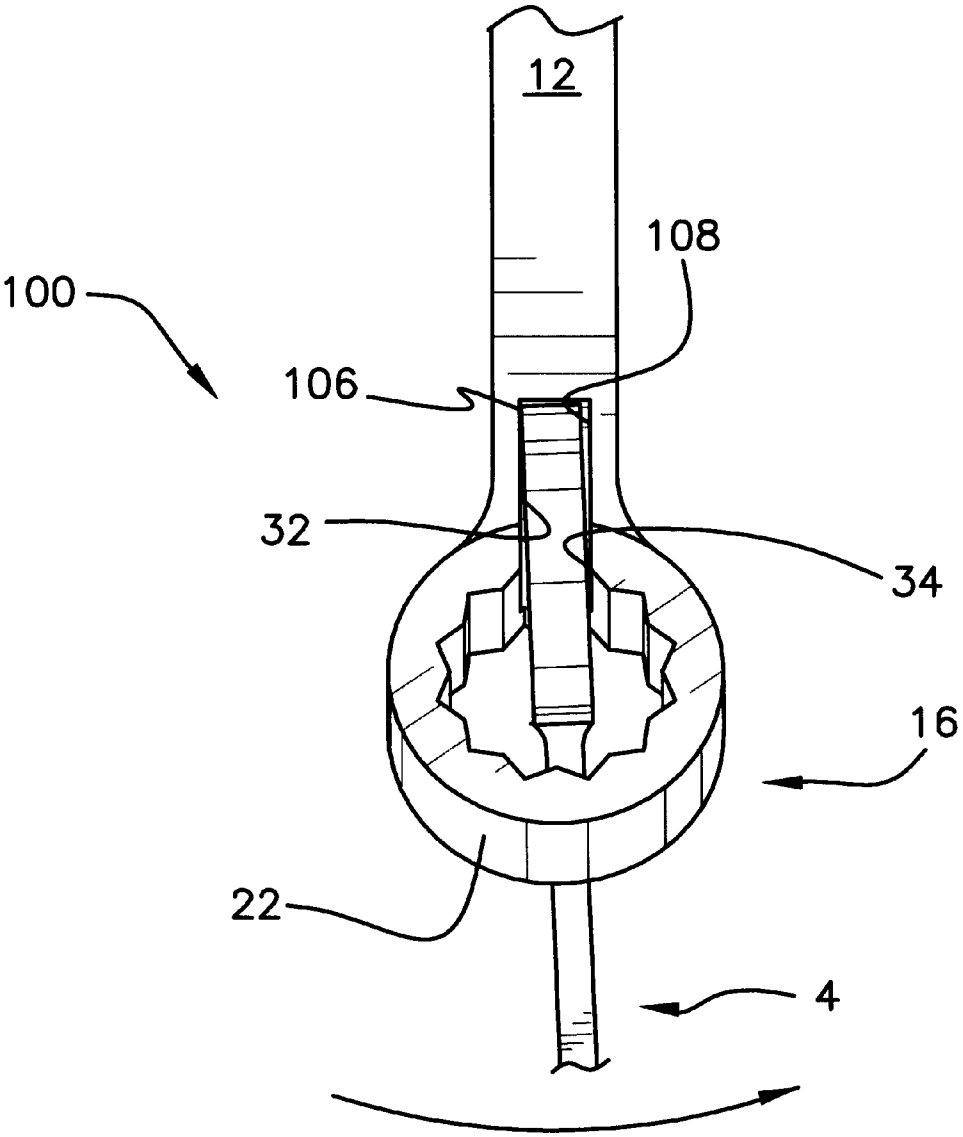
FIG. 4 is an environmental, top plan detail view of the invention, taken along line 4—4 of FIG. 1.

FIG. 4 shows right and left lateral entrapment of jaw 8A of wrench 4. When torque is applied to turn wrench 10 in the direction indicated by arrow A, which would be appropriate for unthreading work piece 2, where work piece 2 has right handed threads, jaw 8A of wrench 4 contacts right lateral stop 106 at a point 32. If receptacle 100 is sufficiently narrow, contact of the handle of wrench 4 at contact point 30 (see FIG. 1) may not occur. Rather, contact will occur between the open ended working head of wrench 4 at a contact point 34. Moving wrench 4 against wrench 10 in the direction of arrow A establishes a couple at points 32 and 34, the couple being represented by arrows B and C. Abutment of wrench 4 with stops 104, 106, and 108 prevents wrench 4 from sliding or otherwise moving out of engagement with receptacle 100 and hence with wrench 10, thereby remaining in secure interlocking engagement with wrench 10 when connected thereto for extending length and leverage of wrench 10.

It will be seen from FIG. 2 that receptacle 100 is aligned longitudinally with handle 12. This relation assures that the auxiliary wrench will be oriented so as to maximally increase effective length of the two engaged wrenches 4, 10.

Figure 5:
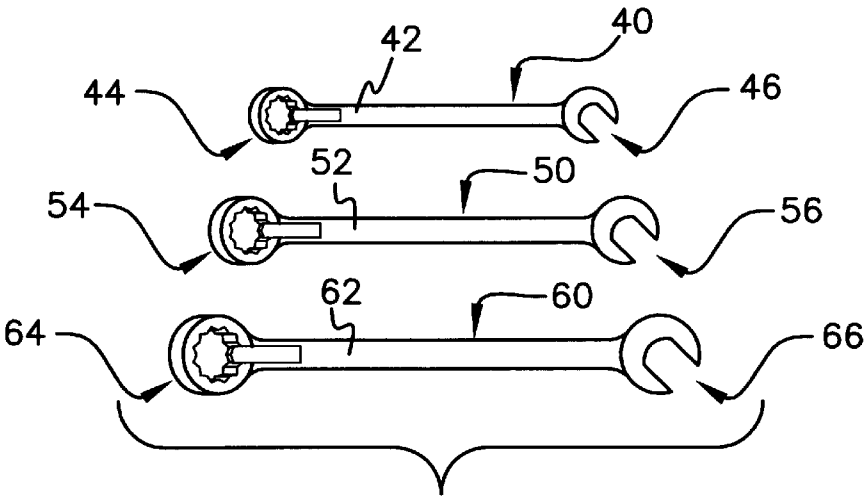
FIG. 5 is a top plan view of the invention, as applied to a set of wrenches.

Turning now to FIG. 5, it is preferred that the invention be provided as a set of interlocking combination wrenches 40, 50, 60, wherein each individual interlocking wrench 40, 50, 60 is capable of securely engaging a second, open ended wrench for improving leverage by combining the length of both. Each wrench 40, 50, or 60 has an elongated handle 42, 52, or 62 (respectively), a box style working head 44, 54, or 64 (respectively) fixed to the proximal end of its respective handle 42, 52, or 62, and a respective open ended working head 46, 56, or 66 fixed to the distal end of its respective handle 42, 52, or 62. Wrenches 40, 50, and 60 differ from one another in that working heads 44, 46, 54, 56, 64, 66 are of different configuration and nominal dimensions from every other working head 44, 46, 54, 56, 64, 66 of other wrenches 40, 50, 60 of the set.

Each working head 44, 54, or 64 has a receptacle equivalent in function to receptacle 100 of wrench 10, described prior. When provided as a set, each box style working head 44, 54, or 64 will be compatible with the open ended head 46, 56, or 66 of a wrench 40, 50, or 60 of a different nominal dimension or size. Preferably, each wrench 40, 50, or 60 is dimensioned and configured to cooperate with a wrench 40, 50, or 60 of an adjacent nominal size.

Figure 7:
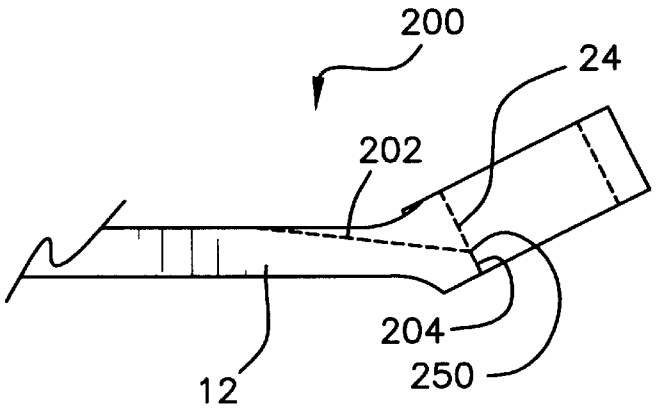
FIGS. 6 and 7 are, respectively, top plan and side elevational detail views of an alternative embodiment of the invention.
Figure 6:
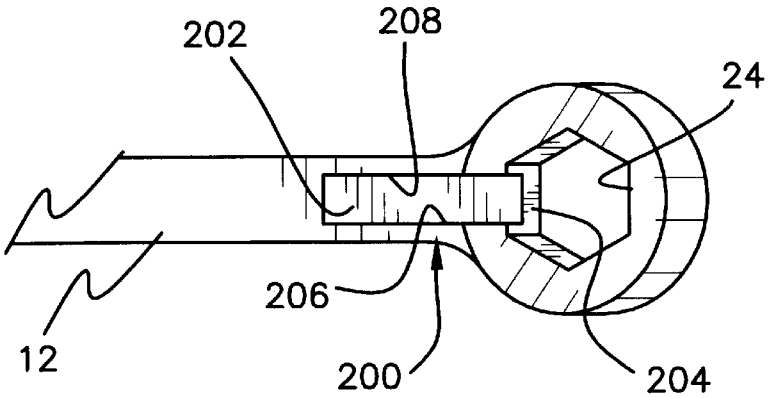

FIG. 6 shows an alternative embodiment of the invention wherein a receptacle 200 differs from receptacle 100 of FIG. 2. In the embodiment of FIG. 6, base surface 202 is arranged to intersect forward stop 204 at the forward end of handle 12 and to intersect work engagement surface 24. Whereas forward stop 104 of the embodiment of FIG. 2 projects above its base surface 102, forward stop 204 of the embodiment of FIG. 6 projects below base surface 202. Right and left lateral stops 206, 208 are essentially unchanged from the embodiment of FIG. 2 other than to reflect the pitch of base surface 202. Since base surface 202 is inclined from a parallel orientation relative to the top and bottom surface of handle 12, the walls of stops 206, 208 will be triangular or irregular in the embodiment of FIG. 6. Pitch of base surface 202 is clearly shown in FIG. 7. Forward stop 204 is located in common with work engagement surface 24.

Figure 9:
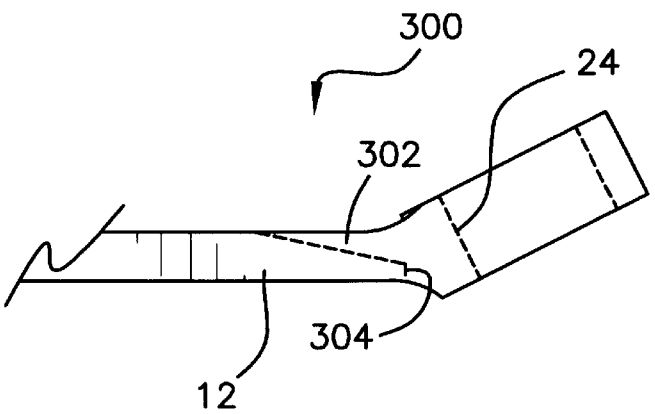
FIGS. 8 and 9 are, respectively, top plan and side elevational detail views of a further embodiment of the invention.
Figure 8:
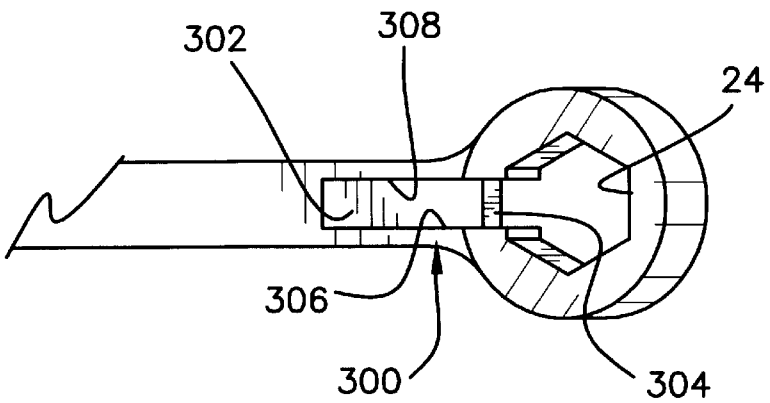

FIG. 8 illustrates another embodiment of the invention wherein base surface 302 of receptacle 300 is arranged to terminate prior to intersecting work engaging surface 24. In the embodiment of FIG. 8, forward stop 304 is located outside work engagement surface 24 and, as clearly seen in FIG. 9, below base surface 302. Base surface 302 avoids contact with work engagement surface 24.

The present invention is susceptible to modifications and variations which may be introduced without departing from the inventive concept. Arrangements of working heads and work engaging structure of the wrench may be varied as desired. The novel receptacle may be formed on both sides of the handle of a wrench improved thereby. The angular orientation of the receptacle may be varied with respect to the handle or to the box style working head of the improved wrench.

The present invention applies also to wrenches having generally box style working heads with a section removed to enable the working head to slip over tubing to engage a compression nut.

It is to be understood that the present invention is not limited to the embodiments described above, but encompasses any and all embodiments within the scope of the following claims.

I claim:

1. An interlocking wrench capable of securely engaging one second, open ended wrench for improving leverage by combining the length of both, said interlocking wrench comprising:

an elongated handle having a proximal end and a distal end; and a working head fixed to said proximal end of said elongated handle, said working head having work gripping structure for engaging an external article to be rotated by said interlocking wrench, said gripping structure occupying a work plane and having an inner work engaging surface, and said elongated handle having a wrench engagement receptacle including a base surface, a forward stop intersecting said base surface, a right lateral stop disposed at the right side of said base surface, and a left lateral stop disposed at the left side of said base surface, whereby the jaw of the second, open ended wrench placed in engagement with said engagement receptacle is prevented from sliding out of engagement with said engagement receptacle when the second, open ended wrench is urged towards said distal end of said elongated handle, the second, open ended wrench thereby remaining in secure interlocking engagement with said interlocking wrench when the second, open ended wrench is connected thereto for extending length and leverage of said interlocking wrench.

2. The interlocking wrench according to claim 1, wherein said base surface of said engagement receptacle is disposed to intersect said inner work engaging surface of said work gripping structure of said working head, whereby a jaw of the open ended wrench may be slid into interlocking engagement with said interlocking wrench after passing through said work gripping structure of said working head.

3. The interlocking wrench according to claim 2, said forward stop located outside said work engagement surface and below said base surface.

4. The interlocking wrench according to claim 1, said base surface disposed to avoid contact with said work engagement surface, and said forward stop located in common with said base surface.

5. The interlocking wrench according to claim 1, wherein said engagement receptacle is recessed into at least said working head, and is disposed to engage a jaw of the second wrench in an orientation such that the second wrench is generally aligned longitudinally with said elongated handle.

6. The interlocking wrench according to claim 5, wherein said wrench engagement receptacle terminates within said elongated handle and does not intersect said work engaging surface.

7. The interlocking wrench according to claim 1, said working head being a box style working head wherein said work gripping structure comprises a generally annular member.

8. The interlocking wrench according to claim 1, said working head being offset from said elongated handle, wherein said work plane is arranged at an intersecting angle to said elongated handle.

9. An interlocking wrench capable of securely engaging one second, open ended wrench for improving leverage by combining the length of both, said interlocking wrench comprising:

an elongated handle having a proximal end, a distal end, and a central plane; and a working head fixed to said proximal end of said elongated handle, said working head having work gripping structure for engaging an external article to be rotated by said interlocking wrench, said gripping structure comprising a generally annular member having an inner work engaging surface and occupying a work plane arranged at an intersecting angle to said central plane of said handle, whereby said working head is offset from said elongated handle, and said elongated handle having a wrench engagement receptacle including a base surface, a forward stop intersecting said base surface, a right lateral stop disposed at the right side of said base surface, and a left lateral stop disposed at the left side of said base surface, whereby the jaw of the second, open ended wrench placed in engagement with said engagement receptacle is prevented from sliding out of engagement with said engagement receptacle when the second, open ended wrench is urged towards said distal end of said elongated handle, the second, open ended wrench thereby remaining in secure interlocking engagement with said interlocking wrench when connected thereto for extending length and leverage of said interlocking wrench, wherein said engagement receptacle is disposed to intersect said inner work engaging surface of said work gripping structure of said working head, whereby a jaw of the second, open ended wrench may be slid into interlocking engagement with said interlocking wrench after passing through said work gripping structure of said working head, and wherein said engagement receptacle is recessed into said working head and into said handle, and is disposed to engage a jaw of the second, open ended wrench in an orientation such that the second, open ended wrench is generally aligned longitudinally with said elongated handle.

10. A set of interlocking wrenches wherein each individual interlocking wrench of said set is capable of securely engaging one second said interlocking wrench of said set for improving leverage by combining the length of both, said set of complementing interlocking wrenches comprising:

a first interlocking wrench and at least one second interlocking wrench, each one of said first and second interlocking wrenches having an elongated handle having a proximal end and a distal end, a box style working head fixed to said proximal end of said elongated handle and an open ended working head fixed to said distal end of said elongated handle, said box style working head of each one said interlocking wrenches being of different configuration and nominal dimensions from every other said box style working head of other said interlocking wrenches of said set, each one of all of said box style working heads of said interlocking wrenches having work gripping structure for engaging an external article to be rotated by its associated said interlocking wrench, said gripping structure occupying a work plane and having an inner work engaging surface, and each said elongated handle having a wrench engagement receptacle including a base surface, a forward stop intersecting said base surface, a right lateral stop disposed at the right side of said base surface, and a left lateral stop disposed at the left side of said base surface, whereby when said first interlocking wrench is placed into engagement with the jaw of said second interlocking wrench, the jaw of said second interlocking wrench is prevented from sliding out of engagement with said engagement receptacle of said first interlocking wrench when said second interlocking wrench is urged towards said distal end of said elongated handle of said first interlocking wrench, said first interlocking wrench and said second interlocking wrench thereby remaining in secure interlocking engagement with one another when connected for extending length and leverage of said first interlocking wrench.

11. The set of interlocking wrenches according to claim 10, wherein said engagement receptacle of each said interlocking wrench of said set is disposed to intersect said inner work engaging surface of said work gripping structure of its associated said working head, whereby a jaw of a selected said interlocking wrench of said set may be slid into interlocking engagement with another said interlocking wrench of said set after passing through said work gripping structure of said working head of said other interlocking wrench of said set.

12. The set of interlocking wrenches according to claim 10, wherein each said engagement receptacle of each said interlocking wrench of said set is recessed into at least said working head of its associated said interlocking wrench, and is disposed to engage a jaw of another said interlocking wrench of said set in an orientation such that said other interlocking wrench is generally aligned longitudinally with said elongated handle of the associated said interlocking wrench of said set.

13. The set of interlocking wrenches according to claim 12, wherein said wrench engagement receptacle of each said interlocking wrench terminates within said elongated handle of its associated said interlocking wrench and does not intersect said work engaging surface of its associated said interlocking wrench.

14. The set of interlocking wrenches according to claim 10, said working head of each said interlocking wrench being a box style working head wherein said work gripping structure comprises a generally annular member.

15. The set of interlocking wrenches according to claim 10, said working head of each said interlocking wrench being offset from said elongated handle of its associated said interlocking wrench, wherein said work plane of each said interlocking wrench is arranged at an intersecting angle to said elongated handle of its associated said interlocking wrench.

16. A set of interlocking wrenches wherein each individual interlocking wrench of said set is capable of securely engaging a second said interlocking wrench of said set for improving leverage by combining the length of both, said set of complementing interlocking wrenches comprising:

a first interlocking wrench and at least a second interlocking wrench, each one of said interlocking wrenches having an elongated handle having a proximal end and a distal end, a box style working head fixed to said proximal end of said elongated handle and an open ended working head fixed to said distal end of said elongated handle, said box style working head of each one said interlocking wrenches being of different configuration and nominal dimensions from every other said box style working head of other said interlocking wrenches of said set, each one of all of said box style working heads of said interlocking wrenches having an elongated handle having a proximal end, a distal end, and a central plane; and a working head fixed to said proximal end of said elongated handle, said working head having work gripping structure for engaging an external article to be rotated by said interlocking wrench, said gripping structure comprising a generally annular member having an inner work engaging surface and occupying a work plane arranged at an intersecting angle to said central plane of said handle, whereby said working head is offset from said elongated handle, and said elongated handle having a wrench engagement receptacle including a base surface, a forward stop intersecting said base surface, a right lateral stop disposed at the right side of said base surface, and a left lateral stop disposed at the left side of said base surface, whereby the jaw of a selected said interlocking wrench placed in engagement with said engagement receptacle of another said interlocking wrench is prevented from sliding out of engagement with said engagement receptacle of said other interlocking wrench when urged towards said distal end of said elongated handle of its associated said interlocking wrench, said selected interlocking wrench thereby remaining in secure interlocking engagement with said other interlocking wrench when connected thereto for extending length and leverage of said selected interlocking wrench and said other interlocking wrench, wherein said engagement receptacle of each said interlocking wrench is disposed to intersect said inner work engaging surface of said work gripping structure of said working head of each said interlocking wrench, whereby a jaw of a selected said interlocking wrench may be slid into interlocking engagement with another said interlocking wrench after passing through said work gripping structure of said working head of said other interlocking wrench, and wherein said engagement receptacle of said other interlocking wrench is recessed into said working head and into said handle of said other interlocking wrench, and is disposed to engage the jaw of said selected interlocking wrench in an orientation such that said selected interlocking wrench is generally aligned longitudinally with said elongated handle of said other interlocking wrench.

* * * * *